US010885864B2

(12) United States Patent
Huang

(10) Patent No.: US 10,885,864 B2
(45) Date of Patent: Jan. 5, 2021

(54) PRE-CHARGE METHOD FOR DISPLAY PANEL, DISPLAY PANEL, AND DISPLAY DEVICE

(71) Applicants: HKC CORPORATION LIMITED, Shenzhen (CN); CHONGQING HKC OPTOELECTRONICS TECHNOLOGY CO., LTD., Chongqing (CN)

(72) Inventor: Xiaoyu Huang, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 16/554,638

(22) Filed: Aug. 29, 2019

(65) Prior Publication Data

US 2020/0135131 A1 Apr. 30, 2020

(30) Foreign Application Priority Data

Oct. 31, 2018 (CN) ..... 2018 1 1283161
Jun. 10, 2019 (CN) ..... 2019 2 0864352 U

(51) Int. Cl.
*G09G 3/36* (2006.01)
*G09G 3/3266* (2016.01)

(52) U.S. Cl.
CPC ..... *G09G 3/3677* (2013.01); *G09G 3/3266* (2013.01); *G09G 2310/0202* (2013.01); *G09G 2310/0251* (2013.01)

(58) Field of Classification Search
CPC ..... G09G 2310/0251; G09G 3/3674–3677
See application file for complete search history.

(56) References Cited

U.S. PATENT DOCUMENTS 9,779,683 B2 * 10/2017 Huang ..... G02F 1/13454
2005/0057465 A1 * 3/2005 Yu ..... G09G 3/3655 345/87
2006/0132056 A1 6/2006 Kim et al.
2016/0210915 A1 * 7/2016 Wang ..... G09G 3/3659
(Continued)

FOREIGN PATENT DOCUMENTS

CN 10555176 A 2/2016
CN 106128377 A 11/2016
(Continued)

OTHER PUBLICATIONS

Yanbo Wen, The ISA written comments, Apr. 2319, CN.

*Primary Examiner* — Sanjiv D. Patel

(57) ABSTRACT

This application discloses a pre-charge method for a display panel, a display panel and a display device. The pre-charge method for the display panel includes steps of outputting a gate enabling signal; receiving an $N^{th}$ gate enabling signal by an $N^{th}$ scan line; and synchronously outputting the $N^{th}$ gate enabling signal to a $(N+1)^{th}$ scan line; N being a natural number more than or equal to 1.

16 Claims, 5 Drawing Sheets

(56) References Cited

U.S. PATENT DOCUMENTS

| | | | | |
|---|---|---|---|---|
| 2017/0236478 | A1* | 8/2017 | Huang | G09G 3/3648 345/215 |
| 2018/0122310 | A1* | 5/2018 | Wang | G02F 1/13624 |

FOREIGN PATENT DOCUMENTS

| | | | |
|---|---|---|---|
| CN | 106683630 | A | 5/2017 |
| CN | 107608153 | A | 1/2018 |

* cited by examiner

PRE-CHARGE METHOD FOR DISPLAY PANEL, DISPLAY PANEL, AND DISPLAY DEVICE

The present application claims priority to Chinese Patent Application No. 201811283161.0, filed Oct. 31, 2018 and No. 201920864352.X, filed Jun. 10, 2019, which is hereby incorporated by reference herein as if set forth in its entirety.

TECHNICAL FIELD

This application relates to the field of display technology, particularly to a pre-charge method for a display panel, a display panel, and a display device.

BACKGROUND

The description herein provides only background information related to this application, but does not necessarily constitute the existing technology.

With the development and advancement of technology, flat panel displays have become mainstream products of displays because of the hot spots of thin body, low power consumption, low radiation and the like, and have been widely used. The flat panel displays include Thin Film Transistor-Liquid Crystal Displays (TFT-LCDs) and Organic Light-Emitting Diode (OLED) displays. The TFT-LCD refracts the light of a backlight module by controlling the rotation direction of liquid crystal molecules to produce pictures, and has many advantages such as thin body, power saving and no radiation. The OLED display is made of an OLED, and has many advantages such as self-illumination, short response time, high definition and contrast, capability of realizing flexible display and large-area full-color display.

The resolution of the liquid crystal display is increasingly high, but the charging time that each line of pixels can obtain is very short, so it is difficult to adjust the charging voltage to a higher level to ensure the display effect.

SUMMARY

The objective of this application is to provide a pre-charge method for a display panel, a display panel, and, a display device, which can realize a pre-charge function in the absence of a Gate-Chip On Film (G-COF).

To achieve the above objective, this application provides a pre-charge method for a display panel, the display panel including: a pre-charge circuit, the pre-charge circuit including a gate driving circuit and a first pre-charge circuit, the first pre-charge circuit including a first trigger switch circuit, the first trigger switch circuit including a first pre-charge switch, including steps of: outputting a gate enabling signal by the gate driving circuit; receiving an $N^{th}$ gate enabling signal by the $N^{th}$ scan line and charging the $N^{th}$ line of pixels; controlling the first pre-charge switch to be turned on by the first trigger switch circuit of the first pre-charge circuit according to the $N^{th}$ gate enabling signal; and synchronously outputting, by the first pre-charge switch, the $N^{th}$ gate enabling signal received by the $N^{th}$ scan line to the $(N+1)^{th}$ scan line; N is a natural number more than or equal to 1.

This application further discloses a display panel including a pre-charge circuit, the pre-charge circuit including: a gate driving circuit configured to a gate enabling signal; a plurality of scan lines respectively connected to the gate driving circuit; and a first pre-charge circuit connected to the $N^{th}$ scan line and the $(N+1)^{th}$ scan line; N is a natural number more than or equal to 1; the first pre-charge circuit includes:

a first trigger switch circuit; and a first pre-charge switch, with a control end connected to an output end of the first trigger switch circuit; when the $N^{th}$ scan line receives an $N^{th}$ gate enabling signal, the first trigger switch circuit controls the first pre-charge switch to be turned on; and the first pre-charge switch synchronously outputs the $N^{th}$ gate enabling signal to the $(N+1)^{th}$ scan line.

This application further discloses a display device, including any of the above display panels.

The requirement for display pictures is increasingly high, and users hope that the pictures can be clear and stable. In order to achieve the clear effect, technicians have continuously improved the resolution. As the resolution improves, the scanning time left for each scan line is very short, so that the charging tune for pixels corresponding to each scan line is very short, which results in a relatively low charging voltage and insufficient brightness, and affects the display effect of the display panel. In order to increase the charging time, a pre-charge circuit is arranged to improve the display of pictures. The pre-charge circuit is directly connected to the $N^{th}$ scan line and the $(N+1)^{th}$ scan line, so that the pre-charge circuit can be controlled to be turned on or off to achieve the objective that when the $N^{th}$ gate enabling signal is received by the $N^{th}$ scan line, the $N^{th}$ gate enabling signal is synchronously output to the $(N+1)^{th}$ scan line to pre-charge the $(N+1)^{th}$ line of pixels, then the $(N+1)^{th}$ line of pixels is charged to a higher charging voltage next time, and the charging voltage can well reach a preset charging voltage to achieve a high-brightness display effect. In addition, sonic gate driving circuits do not support the function of simultaneously outputting two lines of gate enabling signals, the gate driving circuits of different suppliers may have different definitions on such function, whereas this process does not need the participation of the gate driving circuit, thereby avoiding the above problem. Even if the gate driving circuit that does not simultaneously output two groups of gate enabling signals is used, the pixels corresponding to the two scan lines can also be charged simultaneously, so that the pre-charge technology can be applied more widely.

BRIEF DESCRIPTION OF DRAWINGS

The accompanying drawings included are used for helping understand the embodiments of this application, constitute a part of this specification, illustrate examples of the embodiments of this application and, together with the description, serve to explain the principles of this application. Apparently, the accompanying drawings in the following description merely show some embodiments of this application, and persons of ordinary skill in the art may still derive other drawings from these accompanying drawings without creative effort. In the figures.

DETAILED DESCRIPTION

Figure 1:
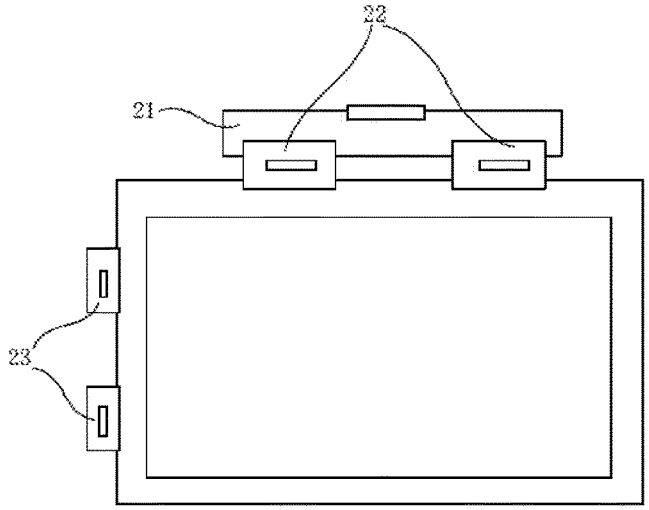
FIG. 1 is a schematic diagram of a display panel according to an embodiment of this application.

Specific structures and functional details disclosed herein are merely representative, and are intended to describe the objectives of the exemplary embodiments of this application. However, this application may be specifically implemented in many alternative forms, and should not be construed as being limited to the embodiments set forth herein.

In the description of this application, it should be understood that orientation or position relationships indicated by the terms such as "center", "transverse", "on", "below", "left", "right". "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application. In addition, the terms such as "first" and "second" are used only for the purpose of description, and should not be understood as indicating or implying the relative importance or implicitly specifying the number of the indicated technical features. Therefore, a feature defined by "first" or "second" can explicitly or implicitly include one or more of said features. In the description of this application, unless otherwise stated, "a plurality of means two or more than two. In addition, the terms Include", "comprise" and any variant thereof are intended to cover non-exclusive inclusion.

In the description of this application, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. Persons of ordinary skill in the art may understand the specific meanings of the foregoing terms in this application according to specific situations.

The terminology used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and: or "comprise" when used in this specification, specify the presence of stated features, integers, steps, operations, elements, and/or components, but do not preclude the presence or addition of one or more other features, integers, steps, operations, elements, components, and/or combinations thereof.

This application is further described below with reference to the accompanying drawings and embodiments.

An Undisclosed Technical Solution

As shown in FIG. 1, Thin Film Transistor-Liquid Crystal Display (TFT-LCF) is one of main varieties of current flat panel displays, and has become an important display platform in modem 11 and video products. According to the main driving principle of TFT-LCD, the system head connects RIG/B compression signals, control signals and a power supply to a connector on a Printed Circuit Board (PCB) 21 through wires, and the data is processed by a Timing. Controller (ICON) IC on the PCB, and then connected to a display area panel by the PCB board through a Source-Chip On Film (S-COF) 22 and a gate-chip on film. (G-COF) 23, so that the display panel obtains the required power supply and signals in order to increase the charging time, a pre-charge technology is used in the existing architecture, that is, the $(N+1)^{th}$ line of gate is enabled while the $N^{th}$ line of gate is enabled and charged, so that the $(N+1)^{th}$ line of pixels can be pre-charged, and then the $(N+1)^{th}$ line of pixels is charged to a target voltage at next time, thereby obtaining longer charging time. The common technology for realizing such function by controlling G-COF through TCON has many limitations.

Figure 2:
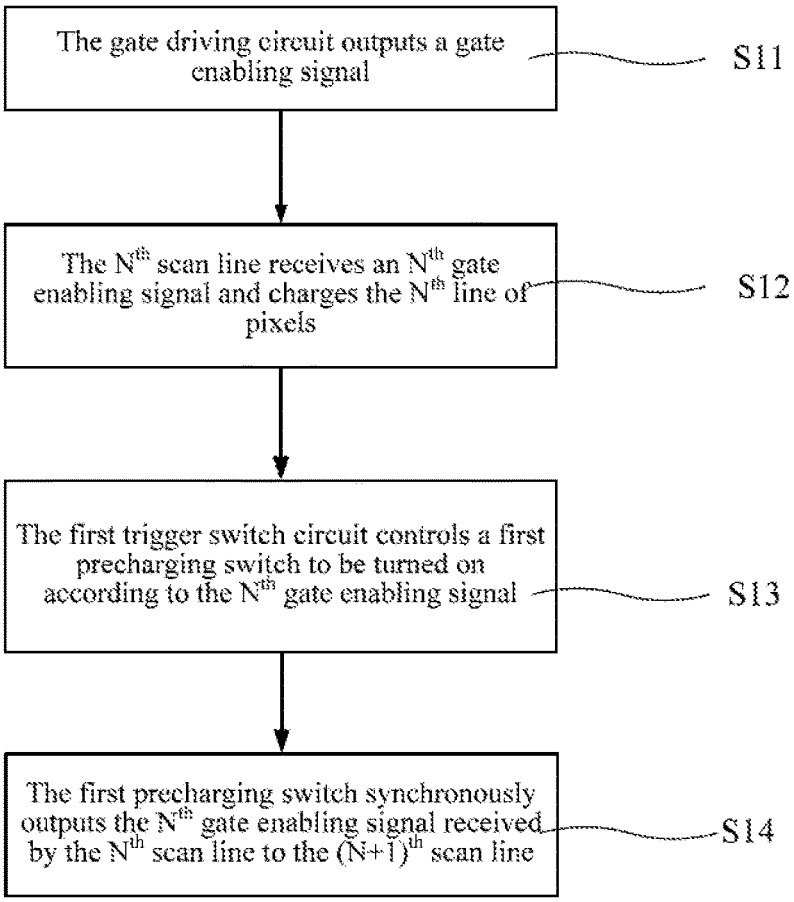
FIG. 2 is a schematic diagram of steps of a pre-charge method according to an embodiment of this application.

As shown in FIG. 2, an embodiment of this application discloses a pre-charge method for a display panel, the display panel including a pre-charge circuit, the pre-charge circuit including a gate driving circuit and a first pre-charge circuit, the first pre-charge circuit including a first trigger switch circuit, the first trigger switch circuit including a first pre-charge switch, including steps of:

S11: outputting a gate enabling signal by the gate driving circuit;

S12: receiving an $N^{th}$ gate enabling signal by the $N^{th}$ scan line and charging the $N^{th}$ line of pixels;

S13: controlling the first pre-charge switch to be turned on by the first trigger switch circuit of the first pre-charge circuit according to the $N^{th}$ gate enabling signal; and

S14: synchronously outputting, by the first pre-charge switch, the $N^{th}$ gate enabling signal received by the $N^{th}$ scan line to the $(N+1)^{th}$ scan line;

N is a natural number more than or equal to 1.

When the gate driving circuit outputs a gate enabling signal, the $N^{th}$ scan line, receives the gate enabling signal, and a first trigger circuit controls a first switch circuit to output a control signal to the first pre-charge switch. The first pre-charge switch is turned on under the control of the control signal, and the first pre-charge switch synchronously outputs the gate enabling signal to the $(N+1)^{th}$ scan line to achieve a good pre-charge effect. The first pre-charge circuit designed in this application synchronously outputs the gate enabling signal received by the $N^{th}$ scan line to the $(N+1)^{th}$ scan line, and pre-charges the $(N+1)^{th}$ lines of pixels. The first pre-charge switch is turned off under the control of a turnoff signal to ensure that the control end of the first pre-charge switch is reset to the initial state to receive a next frame of signals and complete the pre-charge operation corresponding to the next frame, and ensure stable pre-charge to achieve a good display effect. At the same time, the influence of parasitic capacitance and the like generated between respective scan lines and data lines on the pre-charge switch can be reduced, and the problem of display error and the like occurring when the parasitic current is charged to the pixels within the non-scanning time is avoided.

In one or more embodiment, the first trigger switch circuit includes a first trigger circuit and a first switch circuit. The control end of the first trigger circuit is connected to the $N^{th}$ scan line and the $(N\pm1)^{th}$ scan line separately.

The step of synchronously outputting, by the first pre-charge switch, the $N^{th}$ gate enabling signal received by the $N^{th}$ scan line to the $(N+1)^{th}$ scan line includes:

when the $N^{th}$ scan line receives the $N^{th}$ gate enabling signal, controlling the first switch circuit to output a control signal to the first pre-charge switch by the first trigger circuit;

turning on the first pre-charge switch under the control of the control signal; and synchronously outputting, by the first pre-charge switch, the $N^{th}$ gate enabling signal to the $(N+1)^{th}$ scan line.

After the step of synchronously outputting, by the first pre-charge switch, the $N^{th}$ gate enabling signal received by the $N^{th}$ scan line to the $(N+1)^{th}$ scan line, the method further includes steps of:

when the $(N+1)^{th}$ scan line receives the $(N+1)^{th}$ gate enabling signal, controlling the first switch circuit to output a turnoff signal to the first pre-charge switch by the first trigger circuit; and turning off the first pre-charge switch under the control of the turnoff signal.

In this solution, when the $N^{th}$ scan line receives the gate enabling signal, the first trigger circuit controls the first switch circuit to output a control signal to the first pre-charge switch, the first pre-charge switch at this time is turned on under the control of the control signal, and the first pre-charge switch synchronously outputs the gate enabling signal to the $(N+1)^{th}$ scan line. When the $(N+1)^{th}$ scan line receives the gate enabling signal, the first trigger circuit controls the first switch circuit to output a turnoff signal to the first pre-charge switch. The first pre-charge switch is turned off under the control of the turnoff signal. Different circuits respectively control the output of different control signals, thereby avoiding effect on the entire pre-charge circuit caused by chaotic operation.

Figure 3:
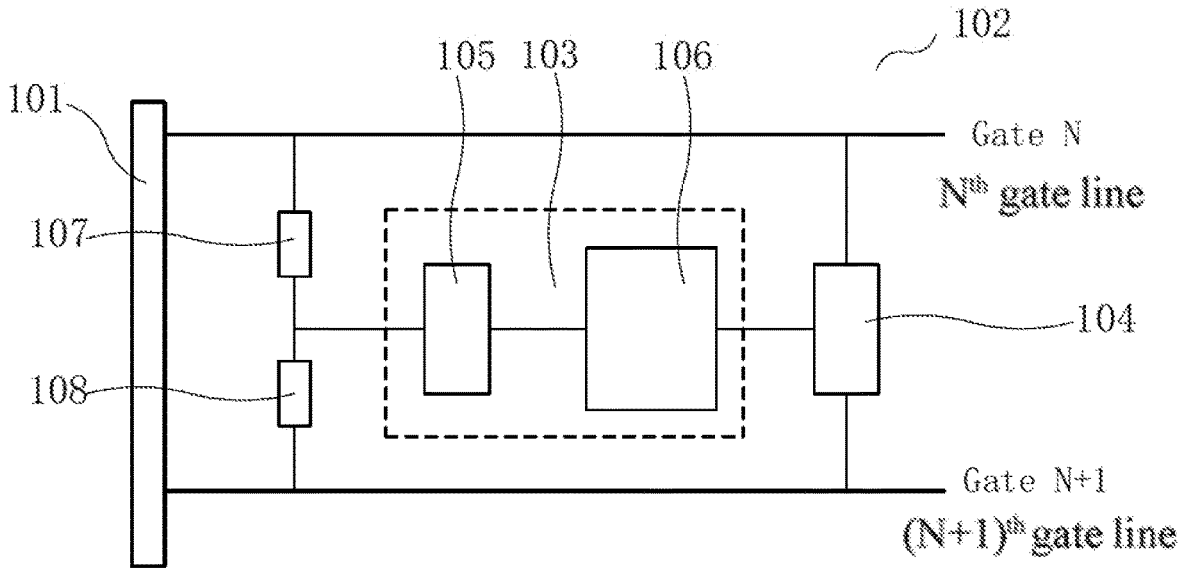
FIG. 3 is a schematic diagram of a pre-charge circuit according to an embodiment of this application.
Figure 4:
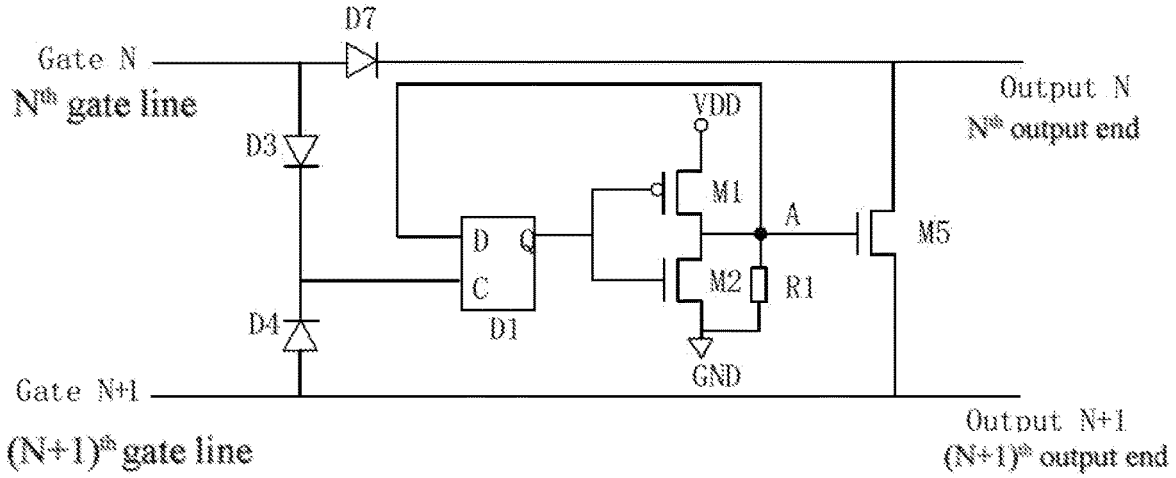
FIG. 4 is a schematic diagram of a first pre-charge circuit of a pre-charge circuit according to an embodiment of this application.
Figure 5:
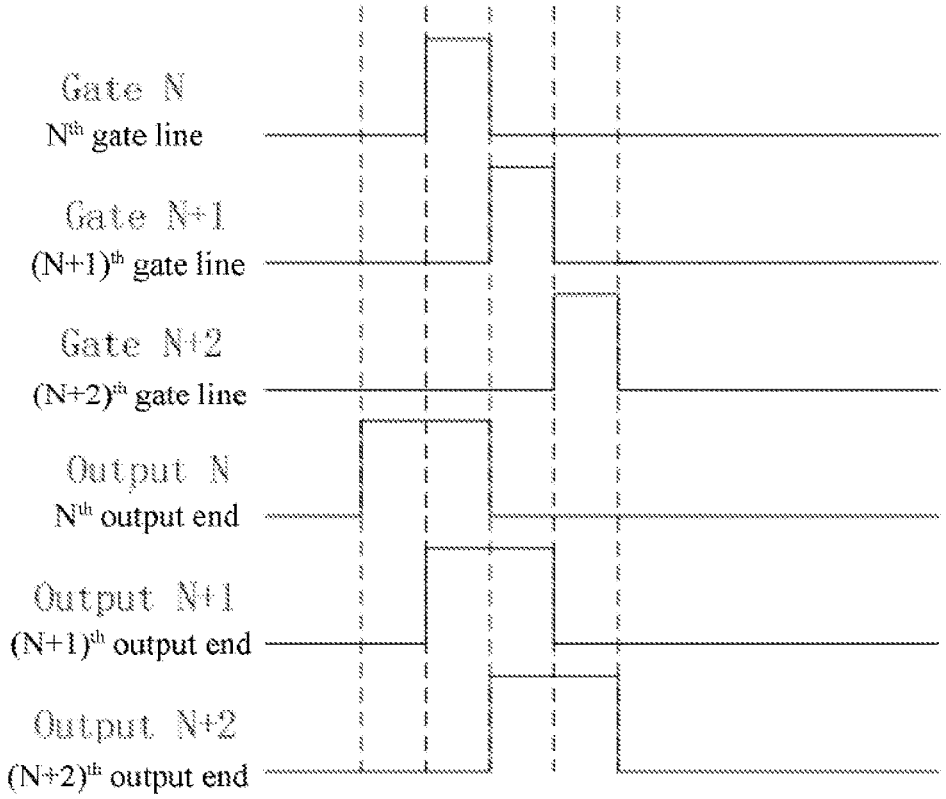
FIG. 5 is a schematic diagram of corresponding waveforms of a pre-charge circuit according to an embodiment of this application.

Another embodiment of this application, as shown in FIG. 3 to FIG. 5, discloses a display panel, including a pre-charge circuit, the pre-charge circuit including:

a gate driving circuit 101, configured to output a gate enabling signal, where the gate driving circuit 101 may be a stand-alone chip or a gate driving circuit directly formed on an Array substrate;

a plurality of scan lines connected to the gate driving circuit 101 respectively; and a first pre-charge circuit 102 connected to the $N^{th}$ scan line and the $(N+1)^{th}$ scan line;

N is a natural number more than or equal to 1.

The first pre-charge circuit 102 includes:

a first trigger switch circuit 103; and a first pre-charge switch 104, having a control end connected to the output end of the first trigger switch circuit 103.

When the $N^{th}$ scan line receives an $N^{th}$ gate enabling signal (Gate N), the first trigger switch circuit 103 controls the first pre-charge switch 104 to be turned on; and the first pre-charge switch 104 synchronously outputs the $N^{th}$ gate enabling signal to the $(N+1)^{th}$ scan line.

In this solution, the requirement for display pictures is increasingly high at present, and users hope that the pictures can be clear and stable. In order to achieve the clear effect, technicians have continuously improved the resolution. As the resolution improves, the scanning time left for each scan line is very short, so that the charging time for pixels corresponding to each scan line is very short, which results in a relatively low charging voltage and insufficient brightness, and affects the display effect of the display panel. In order to increase the charging time, a pre-charge circuit is arranged to improve the display of pictures. The pre-charge circuit is directly connected to the $N^{th}$ scan line and the $(N+1)^{th}$ scan line, so that the pre-charge circuit can be controlled to be turned on or off to achieve the objective that when the $N^{th}$ gate enabling signal is received by the $N^{th}$ scan line, the gate enabling signal is synchronously output to the $(N+1)^{th}$ scan line to pre-charge the $(N+1)^{th}$ line of pixels, then the $(N+1)^{th}$ line of pixels is charged to a higher charging voltage next time, and the charging voltage can well reach a preset charging voltage to achieve a high-brightness display effect. In addition, some gate driving circuits 101 do not support the function of simultaneously outputting two lines of gate enabling signals, the gate driving circuits 101 of different suppliers may have different definitions on such function, whereas this process does not need the participation of the gate driving circuit 101, thereby avoiding the above problem. Even if the gate driving circuit 101 that does not simultaneously output two groups of gate enabling signals is used, the pixels corresponding to the two scan lines can also be charged simultaneously, so that the pre-charge technology can be applied more widely.

In one or more embodiment, the first pre-charge circuit further includes:

a first single guide circuit 107, having an input end connected to the Nth scan line, and an output end connected to the input end of the first trigger switch circuit 103; and a second single guide circuit 108, having an input end connected to the $(N+1)^{th}$ scan line, and au output end connected to the output end of the first single guide circuit and the input end of the first trigger switch circuit 103.

Gate enabling signal in scan line N cannot be output to scan line N+1 through the second single guide circuit 108, then the first trigger switch circuit 103 outputs a high level to control the first pre-charge switch 104 to be turned on, and the $(N+1)^{th}$ scan line is charged while the $N^{th}$ scan line is charged, thereby ensuring that each line can have a longer charging time to achieve a good charging effect; the second single guide circuit 108 is disposed to the first trigger when the gate enabling signal scans the $(N+1)^{th}$ scan line, and then the first trigger switch circuit 103 outputs a low level to control the first pre-charge switch 104 to be turned off, thereby preventing the $(N+1)^{th}$ scan line from simultaneously charging the $N^{th}$ scan line, and preventing the pre-charge switches corresponding to all the scan lines from being turned on during the non-scanning period to avoid the problems that the scan lines are charged all the time and may not work normally and even are all burnt out; and through the second single guide circuit 108, the pre-charge circuit can automatically control the pull-down of the potential of the control end of the previous line of pre-charge switch, thereby achieving a good potential pull-down effect, and ensuring that the pre-charge switch can maintain a low-level potential and be turned off in the non-scanning period (for example, the scanning period of the $(N+1)^{th}$ scan line is the one when the $N^{th}$ scan line and the $(N+1)^{th}$ scan line receive a gate enabling signal, and the scanning period of other lines is the non-scanning period thereof.), which helps to the stability of the circuit, prevents parasitic current generated by parasitic capacitance or other signal interference from being charged to the corresponding pixels, avoids the problem of display error and guarantees the display effect of the display panel.

The first trigger switch circuit 103 includes a first trigger circuit 105 and a first switch circuit 106. The control end of the first trigger circuit 105 is connected to the $N^{th}$ scan line and the $(N+1)^{th}$ scan line separately.

When the $N^{th}$ scan line receives an $N^{th}$ gate enabling signal (Gate N), the first trigger circuit 105 controls the first switch circuit 106 to output a control signal to the first we-charge switch 104; the first pre-charge switch 104 is turned on under the control of the control signal; and the first pre-charge switch 104 synchronously outputs the $N^{th}$ gate enabling signal to the $(N+1)^{th}$ scan line.

When the $(N+1)^{th}$ scan line receives the $(N+1)^{th}$ gate enabling signal, the first trigger circuit 105 controls the first switch circuit 106 to output a turnoff signal to the first pre-charge switch 104; and the first pre-charge switch 104 is turned off under the control of the turnoff signal.

In this solution, when the $N^{th}$ scan line receives an $N^{th}$ gate enabling signal, the first trigger circuit 105 controls the first switch circuit 106 to output a control signal to the first pre-charge switch 104; the first pre-charge switch 104 is turned on under the control of the control signal, and synchronously outputs the $N^{th}$ gate enabling signal to the $(N+1)^{th}$ scan line to achieve a good pre-charge effect; when the $(N+1)^{th}$ scan line receives the $N^{th}$ gate enabling signal, the first trigger circuit 105 controls the first switch circuit 106 to output a turnoff signal to the first pre-charge switch 104, and the first pre-charge switch 104 is turned off under the control of the turnoff signal, to ensure that the control end of the first pre-charge switch 104 is reset to the initial state to receive a next frame of signals and complete the pre-charge operation corresponding to the next frame, and ensure stable pre-charge to achieve a good display effect; at the same time, the influence of parasitic capacitance and the like generated between respective scan lines and data lines on the pre-charge switch can be reduced, and the problem of display error and the like occurring when the parasitic current and other signals are charged to the pixels within the non-scanning time is avoided.

In one or more embodiment, the first trigger circuit 105 includes a first trigger D1; the first trigger D1 is a rising edge trigger; The first switch circuit 106 includes a supply voltage VDD, a first resistor R1, a first switch tube M1 and a second switch tube M2; The first pre-charge switch 104 includes a fifth switch tube M5; the first single guide circuit includes a first diode and a fifth diode, a second single guide circuit includes a second diode; the fifth diode connected to the output end of the $N^{th}$ scan line and the input end of the scanning line of the $N^{th}$, the fifth diode is to control the output of the gate enabling signal of the scanning line of the $N^{th}$.

The switch tube is generally a Metal Oxide Semiconductor (MOS) field effect transistor, the switch tube having a positive control end generally refers to a P-MOS transistor, the switch tube having a negative control end generally refers to an N-MOS transistor, of course, the switch tubes may be other devices capable of realizing similar functions;

The control end of the first switch tube M1 is negatively conducted, and the control ends of the second switch tube M2 and the fifth switch tube M5 are positively conducted; the source of the fifth switch tube M5 is connected to the $N^{th}$ scan line, the drain is connected to the $(N+1)^{th}$ scan line, and the gate is connected to an input pin D of the first trigger and is grounded (GND) through the first resistor; the source of the first switch tube M1 is connected to the supply voltage, the drain is connected to the gate of the fifth switch tube M2, and the gate is connected to an output pin Q of the first trigger; the source of the second switch tube M2 is connected to the drain of the first switch tube the drain is grounded, and the gate is connected to the output pin Q of the first trigger; A control pin C of the first trigger D1 is connected to the $N^{th}$ scan line and the $(N+1)^{th}$ scan line separately. When the first trigger receives a rising edge signal, the logic level of the input pin D thereof is assigned to the output pin Q.

In this solution, the supply voltage VDD in the first pre-charge circuit 102 is of a logic high level, a logic low level L is obtained by resistance grounding, the second switch tube and the fifth switch tube are N-MOS transistors, M2 and M5 are turned off when the gate enabling signal is of the logic low level L, and M2 and M5 are turned on when the gate enabling signal is of the logic high level H; the first switch tube is a P-MOS transistor. M1 is turned on when the enabling signal is L, and M1 is turned off when the gate enabling signal is H; in the initial state, because of the grounding action of the first resistor, the output voltage at the first resistor is of the logic low level, at this time, M5 is turned off, and the D value of the first trigger is of the logic low level; at this time, no Q value of the first trigger is output, and M1 and M2 are both turned off, when the rising edge of the $N^{th}$ scan line arrives, the control pin C of the first trigger receives the rising edge, D1 assigns L of the D value to Q at this time, M1 is turned on, M2 is turned off, and the logic level of point A is H. The D value of D1 is H; at this time, M5 is turned on, and Output N=Output N+1. Thus, the $(N+1)^{th}$ line, of pixels can be pre-charged while the $N^{th}$ line of pixels is scanned to ensure a higher voltage value and achieve a higher display effect. At the same time, the pre-charge switch is kept off during the non-scanning period, so that it can be ensured that the corresponding pre-charge switch can complete stable pre-charge operation without the problem that the display panel may not work normally and even is damaged because all the pre-charge switches are turned on. Moreover, the condition that the pre-charge switch is not turned off is avoided, so that the influence of parasitic capacitance and the like generated between respective scan lines and data lines on the pre-charge switch and the corresponding lines of pixel is reduced, and the problems of display error and the like caused by the fact that parasitic current is charged to the pixels within the non-scanning time is avoided.

Figure 6:
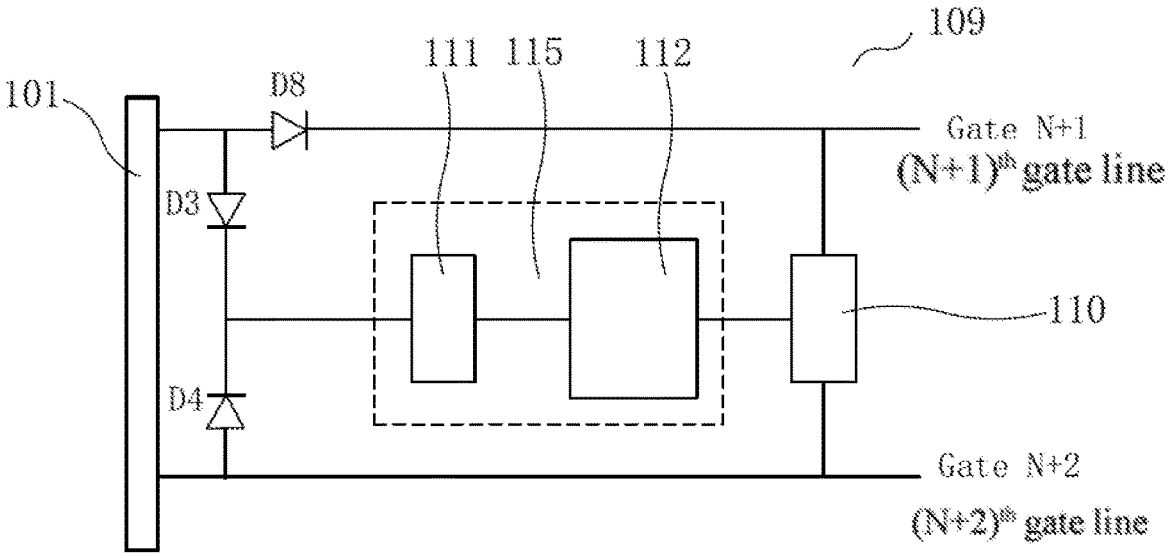
FIG. 6 is a schematic diagram of a second pre-charge circuit of a pre-charge circuit according to an embodiment of this application.
Figure 7:
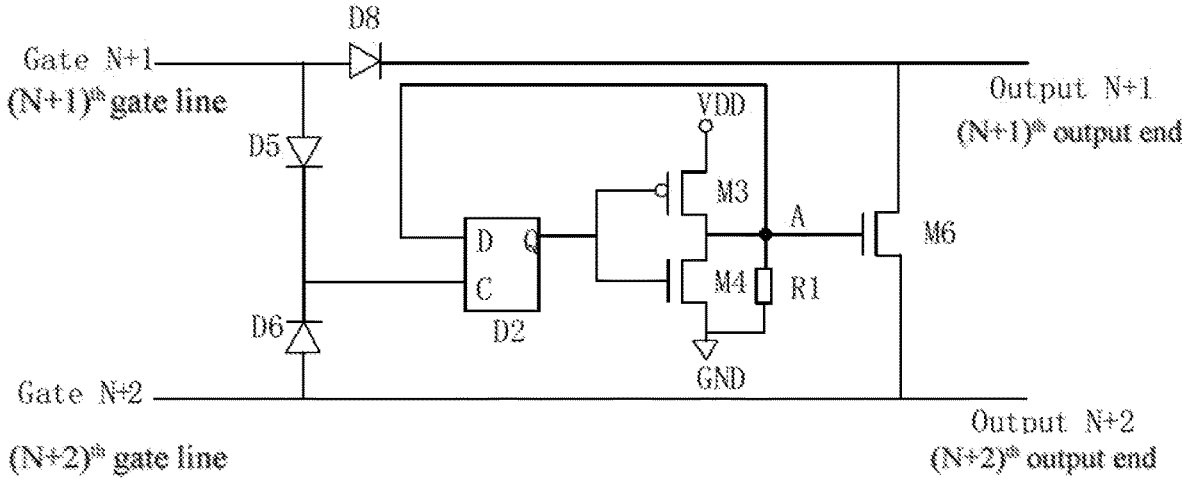
FIG. 7 is a schematic diagram of a pre-charge circuit according to an embodiment of this application.

In one or more embodiments, a display panel is disclosed, including a pre-charge circuit. Referring to FIG. 5 to FIG. 7, the pre-charge circuit includes:

a gate driving circuit, configured to output a gate enabling signal (Gate), where the gate driving circuit may be a stand-alone chip or a gate driving circuit directly formed on an Array substrate;

a plurality of scan lines connected to the gate driving circuit respectively; and a second pre-charge circuit 109 corresponding to the first pre-charge circuit 102 and connected to the $(N+1)^{th}$ scan line and the $(N+2)^{th}$ scan line.

The second pre-charge circuit 109 includes:

a second trigger switch circuit 115 including a second trigger circuit 111 and a second switch circuit 112; and a second pre-charge switch 110, having a control end connected to an output end of the second switch circuit 112.

When the $(N+1)^{th}$ scan line receives an $(N+1)^{th}$ gate enabling signal, the second trigger switch circuit 111 controls the second switch circuit 112 to output a high level; and the second pre-charge switch 110 is turned on under the control of the high level, and synchronously outputs the $(N+1)^{th}$ gate enabling signal to a $(N+2)^{th}$ scan line.

In this solution, when the $(N+1)^{th}$ scan line receives a gate enabling signal, the pre-charge circuit synchronously outputs the gate enabling signal to the $(N+2)^{th}$ scan line such that the $(N+2)^{th}$ line of pixels can be pre-charged, and the $(N+2)^{th}$ line of pixels is charged to a target voltage next time, thereby obtaining a longer charging time. In this way, according to this solution, the pre-charge circuit can be set for the entire panel to achieve the purpose that all the scan lines of the entire panel can be pre-charged, and the pre-charge time is almost twice the original, thereby ensuring that the pixels corresponding to each scan line reach a higher charging voltage, and reducing the power consumption.

In one or more embodiments, the second pre-charge circuit further includes:

a third diode D5, having an input end connected to the $(N+1)^{th}$ scan line, and an output end connected to the input end of the second trigger switch circuit; and a fourth diode D6, having an input end connected to the $(N+2)^{th}$ scan line, and an output end connected to the output end of the third diode and the input end of the second trigger switch circuit;

a sixth diode D8, the sixth diode connected to the output end of the $(N+1)^{th}$ scan line and the input end of the scanning line of the $(N+1)^{th}$, the sixth diode is to control the output of the gate enabling signal of the scanning line of the $(N+1)^{th}$ When the gate enabling signal of the $(N+1)^{th}$ is turned on to charge the scanning line of the $(N+1)^{th}$, the gate enabling signal of the $(N+1)^{th}$ cannot be output to the scanning line of the $(N+2)^{th}$ through the fourth diode, then the second trigger switch circuit 115 outputs a high level to control the second pre-charge switch 110 to be turned on, and the $(N+2)^{th}$ scan line is charged while the $(N+1)^{th}$ scan line is charged, thereby ensuring that each line can have a longer charging time to achieve a good charging effect; the fourth diode D6 is arranged to turn on the second trigger when the gate enabling signal scans the $(N+2)^{th}$ scan line, and then the second switch circuit 112 outputs a low level to control the second pre-charge switch 110 to be turned off, thereby preventing the $(N+2)^{th}$ scan line from simultaneously charging the $(N+1)^{th}$ scan line, and preventing the pre-charge switches corresponding to all the scan lines from being turned on during the non-scanning period to avoid the problems that the scan lines are charged all the time and may not work normally and even are all burnt out; and through the fourth diode, the pre-charge circuit can automatically control the pull-down of the potential of the control end of the previous line of pre-charge switch, thereby achieving a good potential pull-down effect, and ensuring that the pre-charge switch can maintain a low-level potential and be turned off in the non-scanning period (for example, the scanning period of the $(N\div2)^{th}$ scan line is the one when the $(N+1)^{th}$ scan line and the $(N+2)^{th}$ scan line receive a gate enabling signal, and the scanning period of other lines is the non-scanning period thereof), which helps to the stability of the circuit, prevents parasitic current generated by parasitic capacitance or other signal interference from being charged to the corresponding pixels, avoids the problem of display error and guarantees the display effect of the display panel.

In one or more embodiment, the second trigger circuit 111 includes a second trigger D2, the second trigger D2 is a rising edge trigger; The second switch circuit 112 includes a supply voltage VDD, a second resistor R2, a third switch tube M3 and a fourth switch tube M4; The second pre-charge switch 110 includes a sixth switch tube M6;

The switch tube is generally a metal oxide semiconductor (MOS) field effect transistor, the switch tube having a positive control end generally refers to a P-MOS transistor, the switch tube having a negative control end generally refers to an N-MOS transistor, of course, the switch tubes may be other devices capable of realizing similar functions;

The control end of the third switch tube is negatively conducted, and the control ends of the fourth switch tube and the sixth switch tube are positively conducted;

The source of the sixth switch tube is connected to the $(N+1)^{th}$ scan line, the drain is connected to the $(N+2)^{th}$ scan line, and the gate is connected to an input pin D of the second trigger and is grounded through the second resistor;

The source of the third switch tube is connected to the supply voltage, the drain is connected to the gate of the sixth switch tube, and the gate is connected to an output pin Q of the second trigger;

The source of the fourth switch tube is connected to the drain of the third switch tube, the drain is grounded, and the gate is connected to the output pin Q of the second trigger;

A control pin C of the second trigger is connected to the $(N+1)^{th}$ scan line and the $(N+2)^{th}$ scan line separately. When the control pin of the second trigger receives a rising edge signal, the logic level of the input pin D thereof is assigned to the output pin Q.

In this solution, the supply voltage in the second pre-charge circuit 109 is of a logic high level H, the second pre-charge circuit 109 obtains a logic low level by resistance grounding, the fourth switch tube and the sixth switch tube are N-MOS transistors, M4 and M6 are turned on when the gate enabling signal is H, and M4 and M6 are turned off when the enabling signal is L; the third switch tube is a P-MOS transistor, M3 is turned on when the gate enabling signal is L, and M3 is turned off when the gate enabling signal is H; in the initial state, because of the grounding action of the third resistor, the output voltage at the second resistor is of the logic low level, at this time, M6 is turned off, and the D value of the second trigger D2 is of the logic low level; at this time, no Q value of the second trigger is output, and M3 and M4 are both turned off when the rising edge of the $(N+1)^{th}$ scan line arrives, the control pin C of the second trigger receives the rising edge, D2 assigns L of the D value to Q, at this time, M3 is turned on, M4 is turned off, and the logic level of point B is H. The D value of D2 is H; at this time, M6 is turned on, and Output N+1=Output N+2. Thus, the $(N+2)^{th}$ line of pixels can be pre-charged while the $(N+1)t^{h}$ line of pixels is scanned to ensure a higher voltage value and achieve a higher display effect. At the same time, the pre-charge switch is kept off during the non-scanning period, which may prevent the condition that the pre-charge switch is turned off, thereby reducing the influence of parasitic capacitance and the like generated between respective scan lines and data lines on the pre-charge switch, and avoiding the problems of display error and the like caused by the fact that parasitic current is charged to the pixels within the non-scanning time.

In one or more embodiments a display panel is disclosed, including a pre-charge circuit. Referring to FIG. 2 to FIG. 7 the pre-charge circuit includes:

a gate driving circuit 101 configured to output a gate enabling signal;

a plurality of scan lines connected to the gate driving circuit 101 respectively;

a first pre-charge circuit connected to the $N^{th}$ scan line and the $(N+1)^{th}$ scan line; and a second pre-charge circuit connected to the $(N+1)^{th}$ scan line and the $(N+2)^{th}$ scan line;

The first pre-charge circuit includes a supply voltage VDD, a first resistor R1, a first trigger D1, a first diode D3, a second diode D4, a first switch tube M1, a second switch tube M2 and a fifth switch tube M5:

The second pre-charge circuit includes a second resistor R2, a second trigger D2, a third diode D5, a fourth diode D6, a third switch tube M3, a fourth switch tube M4 and a sixth switch tube M6;

The source of the fifth switch tube is connected to the $N^{th}$ scan line, the drain is connected to the $(N+1)^{th}$ scan line, and the gate is connected to an input pin D of the first trigger and is grounded through the first resistor;

The source of the first switch tube is connected to the supply voltage, the drain is connected to the gate of the fifth switch tube, and the gate is connected to an output pin Q of the first trigger;

The source of the second switch tube is connected to the drain of the first switch tube, the drain is grounded, and the gate is connected to the output pin Q of the first trigger;

A control pin C of the first trigger is connected to the $N^{th}$ scan line and the $(N+1)^{th}$ scan line separately, and when the control pin C of the first trigger receives a rising edge, the logic level of the input pin D thereof is assigned to the output pin Q;

The input end of first diode 107 is connected to the $N^{th}$ scan line, and the output end is connected to the control pin C of the first trigger;

The input end of second diode 108 is connected to the $(N+1)^{th}$ scan line, and the output end is connected to the output end of the first diode 107 and the control pin C of the first trigger;

The source of the sixth switch tube is connected to the $(N+1)^{th}$ scan line, the drain is connected to the $(N+2)^{th}$ scan line, and the gate is connected to an input pin D of the second trigger and is grounded through the second resistor;

The source of the third switch tube is connected to the supply voltage, the drain is connected to the gate of the sixth switch tube, and the gate is connected to an output pin of the second trigger;

The source of the fourth switch tube is connected to the drain of the third switch tube, the drain is grounded, and the gate is connected to the output pin of the second trigger;

A control pin of the second trigger is connected to the $(N+1)^{th}$ scan line and the $(N+2)^{th}$ scan line separately, the second trigger is a rising edge D trigger, and functions to assign, when the control end C of the second trigger receives a rising edge, the logic level of the end D thereof to the Q.

The input end of the third diode D5 is connected to the (N+1) scan line, and the output end is connected to the control pin C of the first trigger;

The input end of the fourth diode D6 is connected to the $(N+2)^{th}$ scan line, and the output end is connected to the output end of the third diode D5 and the control pin of the second trigger;

The first switch tube and the third switch tube are P-MOS transistors, and the second switch tube, the fourth switch tube, the fifth switch tube and the sixth switch tube are N-MOS transistors:

The fifth diode D7 connected to the output end of the $N^{th}$ scan line and the input end of the scanning line of the $N^{th}$, the fifth diode is to control the output of the gate enabling signal of the scanning line of the $N^{th}$;

The sixth diode D8 connected to the output end of the $(N+1)^{th}$ scan line and the input end of the scanning line of the $(N+1)^{th}$, the sixth diode, is to control the output of the gate enabling signal of the scanning line of the $(N+1)^{th}$.

The seventh diode D9 connected to the output end, of the (N+2) scan line and the input end of the scanning line of the $(N+2)^{th}$, the seventh diode is to control the output of the gate enabling signal of the scanning line of the $(N+1)^{th}$ In this solution, VDD is of a logic high level H, and GND is of a logic low level L; R1 band R2 are grounding resistors. M2, M4, M5 and M6 are P-MOS, and are turned on when the gate enabling signal is H and turned off when the gate enabling signal is L; M1 and M3 are N-MOS, and are turned on when the gate enabling signal is L and turned off when the gate enabling signal is H; D1 and D2 are rising edge D triggers, and function to assign, when the control end C thereof receives a rising edge signal, the logic level of the D end thereof to the Q; D3, D4, D5, D6, D7, D8 and D9 are diodes, the fifth diode D7 is in series on the $N^{th}$ scan line, the sixth diode D8 is in series on the $(N+1)^{th}$ scan line, and the seventh diode D9 is in series on the $(N+2)^{th}$ scan line. All diodes have unidirectional conductivity; Gate N, Gate N+1 and Gate N+2 are actual outputs of G-COF; Output N, Output N+1 and Output N+2 are turn-on signals actually input to the panel. In practical application, the initial state: because of the grounding resistance of R1 and R2, the outputs of A and B are both L at this time, M5 and M6 are turned off, the D value of D1 is L, and the D value of D2 is L no Q values of D1 and D2 are output, and M1, M2, M3 and M4 are all turned off; when the rising edge of Gate N arrives, the C of D1 receives the rising edge. D1 assigns L of the D value thereof to the Q, at this time, M1 is turned on, M2 is turned off, and the logic level of point A is H. The D value of D1 is H. At this time, M5 is turned on, and Output N=Output N+1. When the rising edge of Gate N+1 arrives, the Cs of D1 and D2 receive the rising edge, D1 assigns H of the D value thereof to the Q, D2 assigns L of the D value thereof to the Q, at this time, M1 and M4 are turned off M1 and M3 are turned on, the logic level of point A is L, and the logic level of point B is H. The D value of D1 is L, and the D value of D2 is H. At this time, M5 is turned off, M6 is turned on, and Output N+1=Output N+2. It can be obtained by a same analysis that: when the rising edge of Gate N+2 arrives, B is L and M6 is turned off. Thus, the $(N+1)^{th}$ line of pixels can be pre-charged while the N line of pixels is scanned to ensure a higher voltage value and achieve a higher display effect. At the same time, the pre-charge switch is kept off during the non-scanning period, which may prevent the condition that the pre-charge switch is not turned off, thereby reducing the influence of parasitic capacitance and the like generated between respective scan lines and data lines on the pre-charge switch, and avoiding the problems of display error and the like caused by the fact that parasitic current is charged to the pixels within the non-scanning time.

Figure 8:
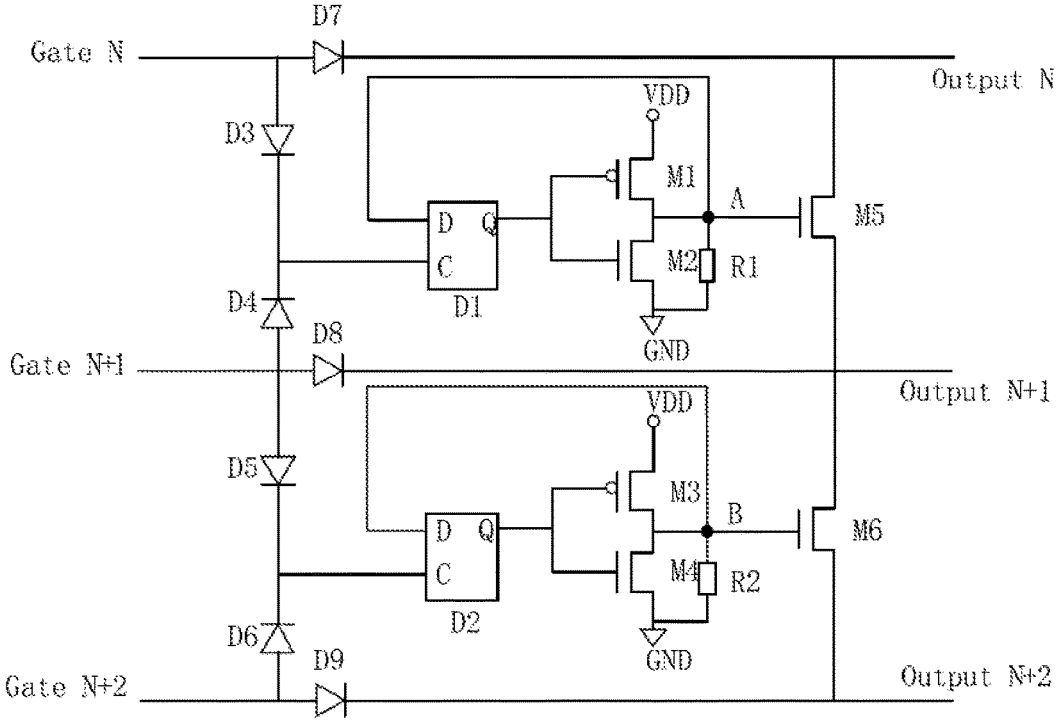
FIG. 8 is a schematic diagram of a pre-charge circuit according to an embodiment of this application.
Figure 9:
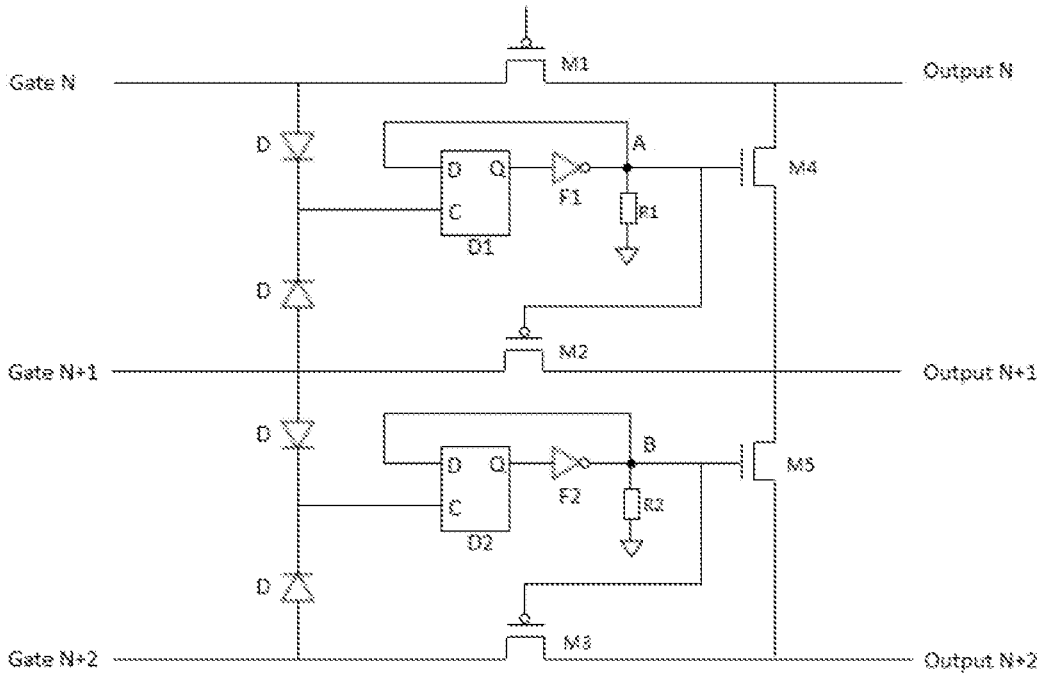
FIG. 9 is a schematic diagram of a pre-charge circuit according to an embodiment of this application.

In one or more embodiments, referring to FIG. 9, Different from the above embodiments, the combination of M1 and M2 in FIG. 8 is simplified to reverser F1, and the combination of M3 and M4 is simplified to reverser F2. Add M1, M2 and M3 to replace D7, D8 and D9 in FIG. 8. M1, M2 and M3 are P-MOS, whose function is to open when the gate control signal is L and close When the gate control signal is H. When N equals 1, the gate end of M1 is connected to a low level, M2 is connected to the gate control signal of M4, and M3 is connected to the gate control signal of M5. This architecture can realize that when M4 is turned on, M2 is closed, avoiding interference to D1. When M5 is turned on, M3 is turned off, avoiding interference to D2. This setting can simplify the circuit, and replace the triode with the diode. When the triode is turned off, it cannot conduct in both directions, so as to avoid the abnormal output of g-cof end affecting the work of the back end. In addition, the triode has higher voltage resistance and better reliability than the diode.

Figure 10:
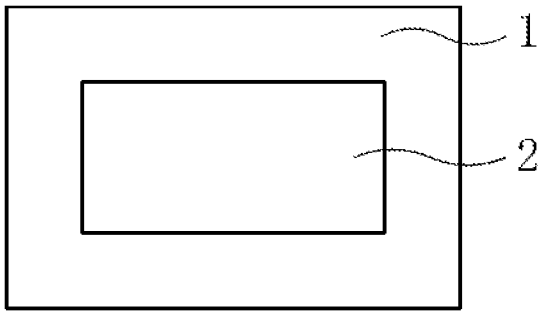
FIG. 10 is a schematic diagram of a display device according to an, embodiment of this application.

In one or more embodiments, referring to FIG. 10, a display device 1 is disclosed, including any of the above display panels 2.

The technical solutions of this application can be widely applied to various flat panel displays, such as thin film transistor-liquid crystal displays (TFT-LCDs) and organic light-emitting diode (OLED) displays are also applicable to the above solutions.

The foregoing contents are detailed descriptions of this application in conjunction with specific preferred embodiments, and it should not be considered that the specific implementation of this application is limited to these descriptions. Persons of ordinary skill in the art can further make simple deductions or replacements without departing from the concept of this application, and such deductions or replacements should all be considered as falling within the protection scope of this application.

What is claimed is:

1. A pre-charge method for a display panel, the display panel comprising a pre-charge circuit, the pre-charge circuit comprising a gate driving circuit and a first pre-charge circuit, the first pre-charge circuit comprising a first trigger switch circuit, the first trigger switch circuit comprising a first pre-charge switch, comprising steps of:

out putting a gate enabling signal by the gate driving circuit;

receiving an $N^{th}$ gate enabling signal by the $N^{th}$ scan line and charging the $N^{th}$ line of pixels;

controlling the first pre-charge switch to be turned on by the first trigger switch circuit of the first pre-charge circuit according to the $N^{th}$ gate enabling signal: and synchronously outputting, by the first pre-charge switch, the $N^{th}$ gate enabling signal received by the $N^{th}$ scan line to the $(N+1)^{th}$ scan line; wherein N is a natural number more than or equal to 1:

wherein the first trigger switch circuit comprises a first trigger circuit and a first switch circuit: the control end of the first trigger circuit is connected to the $N^{th}$ scan line and the $(N+1)^{th}$ scan line separately, the step of synchronously outputting, by the first pre-charge switch, the $N^{th}$ gate enabling signal received by the N scan line to the $(N+1)^{th}$ scan line comprises:

when the $N^{th}$ scan line receives the $N^{th}$ gate enabling signal, controlling the first switch circuit to output a control signal to the first pre-charge switch;

turning on the first pre-charge switch under the control of the control signal: and synchronously outputting, by the first pre-charge switch, the $N^{th}$ gate enabling signal to the $(N+1)^{th}$ scan line:

after the step of synchronously outputting, the first ore-charge switch, the $N^{th}$ gate enabling signal received by the $N^{th}$ scan line to the $(N+1)^{th}$ scan line, the method further comprises steps of:

when the $(N+1)^{th}$ scan line receives the $(N+1)^{th}$ gate enabling signal, controlling the first switch circuit to output a turnoff signal to the first pre-charge switch by the first trigger circuit; and turning off the first pre-charge switch under the control of the turnoff signal.

2. A display panel, comprising a pre-charge circuit, the pre-charge circuit comprising:

a gate driving circuit configured to output a gate enabling signal;

a plurality of scan lines connected to the gate driving circuit respectively; and a first pre-charge circuit connected to the $N^{th}$ scan line and the $(N+1)^{th}$ scan line; wherein N is a natural number more than or equal to 1;

the first pre-charge circuit comprising:

a first trigger switch circuit; and a first pre-charge switch, having a control end connected to the output end of the first trigger switch circuit; wherein when the $N^{th}$ scan line receives an $N^{th}$ gate enabling signal, the first trigger switch circuit controls the first pre-charge switch to be turned on; and the first pre-charge switch synchronously outputs the $N^{th}$ gate enabling signal to the $(N+1)^{th}$ scan line;

wherein the first pre-charge circuit further comprises:

a first single guide circuit, having an input end connected to the $N^{th}$ scan line, and an output end connected to the input end of the first trigger switch circuit: and a second single guide circuit, having an input end connected to the $(N+1)^{th}$ scan line, and an output end connected to the output end of the first single guide circuit and the input end of the first trigger switch circuit.

3. The display panel according to claim 2, wherein the first trigger switch circuit comprises a first trigger circuit and a first switch circuit; the control end of the first trigger circuit is connected to the $N^{th}$ scan line and the $(N+1)^{th}$ scan line separately;

when the $N^{th}$ scan line receives an $N^{th}$ gate enabling signal, the first trigger circuit controls the first switch circuit to output a control signal to the first pre-charge switch, the first, pre-charge switch is turned on under the control of the control signal, and the first pre-charge switch synchronously outputs the $N^{th}$ gate enabling signal to the $(N+1)^{th}$ scan line; and when the $(N+1)^{th}$ scan line receives an $(N+1)^{th}$ gate enabling signal, the first trigger circuit controls the first switch circuit to output a turnoff signal to the first pre-charge switch, and the first pre-charge switch is turned off under the control of the turnoff signal.

4. The display panel according to claim 3, wherein the first trigger circuit comprises a first trigger; the first switch circuit comprises a supply voltage, a first resistor, a first switch tube and a second switch tube; the first pre-charge switch comprises a fifth switch tube;

the control end of the first switch tube is negatively conducted, and the control ends of the second switch tube and the fifth switch tube are positively conducted:

the source of the fifth switch tube is connected to the $N^{th}$ scan line, the drain is connected to the $(N+1)^{th}$ scan line, and the gate is connected to an input pin of the first trigger and is grounded through the first resistor:

the source of the first switch tube is connected to the supply voltage, the drain is connected to the gate of the fifth switch tube, and the gate is connected to an output pin of the first trigger;

the source of the second switch tube is connected to the drain of the first switch tube, the drain is grounded, and the gate is connected to the output pin of the first trigger;

a control pin of the first trigger is connected to the $N^{th}$ scan line and the $(N+1)^{th}$ scan line separately, and when the control pin of the first trigger receives a rising edge signal, the first trigger assigns the logic level of the input pin to the output pin.

5. The display panel according to claim 4, wherein the first single guide circuit comprises a first diode and a fifth diode, a second single guide circuit comprises a second diode;

the fifth diode connected to, the output end of the $N^{th}$ scan line and the input end of the scanning line of the $N^{th}$, the fifth diode is to control the output of the gate enabling signal of the scanning line of the $N^{th}$;

the control end of the first switch tube is a negatively conducted triode, and the control ends of the second switch tube and the fifth switch tube are positively conducted triodes.

6. The display panel according to claim 2, wherein the pre-charge circuit further comprises:

a second pre-charge circuit corresponding to the first pre-charge circuit and connected to the $(N+1)^{th}$ scan line and the $(N+2)^{th}$ scan line:

the second pre-charge circuit comprises:

a second trigger switch circuit; and a second pre-charge switch, having a control end connected to the output end of the second trigger switch circuit; wherein when the $(N+1)^{th}$ scan line receives an $(N+1)^{th}$ gate enabling signal, the second trigger switch circuit controls the second pre-charge switch to be turned on; and the second pre-charge switch synchronously outputs the $(N+1)^{th}$ gate enabling signal to the $(N+2)^{th}$ scan line.

7. The display panel according to claim 6, wherein the second pre-charge circuit further comprises:

a third diode, having an input end connected to the $(N+1)^{th}$ scan line, and an output end connected to the input end of the second trigger switch circuit; and a fourth diode, having an input end connected to the $(N+2)^{th}$ scan line, and an output end connected to the output end of the third diode and the input end of the second trigger switch circuit;

a sixth diode the sixth diode connected to the output end of the $(N+1)^{th}$ scan line and the input end of the scanning line of the $(N+1)^{th}$, the sixth diode is to control the output of the gate enabling signal of the scanning line of the $(N+1)^{th}$.

8. The display panel according to claim 7, wherein the second trigger switch circuit comprises a second trigger circuit and a second switch circuit; the control end of the second trigger circuit is connected to the $(N+1)^{th}$ scan line and the $(N+2)^{th}$ scan line separately;

when the $(N+1)^{th}$ scan line receives an $(N+1)^{th}$ gate enabling signal, the second trigger circuit controls the second switch circuit to output a control signal to the second pre-charge switch, the second pre-charge switch is turned on under the control of the control signal, and the second pre-charge switch synchronously outputs the $(N+1)^{th}$ gate enabling signal to the $(N+2)^{th}$ scan line; and when the $(N+2)^{th}$ scan line receives an $(N+2)^{th}$ gate enabling signal, the second trigger circuit controls the second switch circuit to output a turnoff signal to the second pre-charge switch, and the second pre-charge switch is turned off under the control of the turnoff signal.

9. The display panel according to claim 8, wherein the second trigger circuit comprises a second trigger; the second switch circuit comprises a supply voltage, a second resistor, a third switch tube and a fourth switch tube; the second pre-charge switch comprises a sixth switch tube;

the control end of the third switch tube is negatively conducted, and the control ends of the fourth switch tube and the sixth switch tube are positively conducted;

the source of the sixth switch tube is connected to the $(N+1)^{th}$ scan line, the drain is connected to the $(N+2)^{th}$ scan line, and the gate is connected to an input pin of the second trigger and is grounded through the second resistor; the source of the third switch tube is connected to the supply voltage, the drain is connected to the gate of the sixth switch tube, and the gate is connected to an output pin of the second trigger; the source of the fourth switch tube is connected to the drain of the third switch tube, the drain is grounded, and the gate is connected to the output pin of the second trigger;

a control pin of the second trigger is connected to the $(N+1)^{th}$ scan line and the $(N+2)^{th}$ scan line separately, and when the control pin of the second trigger receives a rising edge signal, the second trigger assigns the logic level of the input pin to ne output pin.

10. The display panel according to claim 8, wherein the control end of the third switch tube is a negatively conducted triode, and the control ends of the fourth switch tube and the sixth switch tube are positively conducted triodes.

11. A display device, comprising a display panel, the display panel comprising a pre-charge circuit, the pre-charge circuit comprising:

a gate driving circuit configured to output a gate enabling signal;

a plurality of scan lines connected to the gate driving circuit respectively;

a first pre-charge circuit connected to the $N^{th}$ scan line and the $(N+1)^{th}$ scan line; and a second pre-charge circuit corresponding to the first pre-charge circuit and connected to the $(N+1)^{th}$ scan line and the $(N+2)^{th}$ scan line; wherein N is a natural number more than or equal to 1;

the first pre-charge circuit comprising:

a first trigger switch circuit; and a first pre-charge switch, having a control end connected to the output end of the first trigger switch circuit; wherein when the $N^{th}$ scan line receives an $N^{th}$ gate enabling signal, the first trigger switch circuit controls the first pre-charge switch to be turned on; and the first pre-charge switch synchronously outputs the $N^{th}$ gate enabling signal to the $(N+1)^{th}$ scan line;

the second pre-charge circuit comprising:

a second trigger switch circuit: and a second pre-charge switch, having a control end connected to the output end of the second trigger switch circuit; wherein when the $(N+1)^{th}$ scan line receives an $(N+1)^{th}$ gate enabling signal, the second trigger switch circuit controls the second pre-charge switch to be turned on; and the second pre-charge switch synchronously outputs the $(N+1)^{th}$ gate enabling signal to the $(N+2)^{th}$ scan line:

wherein the first trigger switch circuit comprises a first trigger circuit and a first switch circuit; the control end of the first trigger circuit is connected to the $N^{th}$ scan line and the $(N+1)^{th}$ scan line separately;

when the $N^{th}$ scan line receives an $N^{th}$ gate enabling signal, the first trigger circuit controls the first switch circuit to output a control signal to the first pre-charge switch, the first pre-charge switch is turned on under the control of the control signal, and the first pre-charge switch synchronously outputs the $N^{th}$ gate enabling signal to the $(N+1)^{th}$ scan line;

wherein the second trigger switch circuit comprises a second trigger circuit and a second switch circuit; the control end of the second trigger circuit is connected to the $(N+1)^{th}$ scan line and the $(N+2)^{th}$ scan line separately;

when the $(N+1)^{th}$ scan line receives an $(H+1)^{th}$ gate enabling signal, the second trigger circuit controls the second switch circuit to output a control signal to the second pre-charge switch, the second pre-charge switch is turned on under the control of the control signal, and the second pre-charge switch synchronously outputs the $(N+1)^{th}$ gate enabling signal to the $(N+2)^{th}$ scan line: and when the $(N+2)^{th}$ scan line receives an $(N+2)^{th}$ gate enabling signal, the second trigger circuit controls the second switch circuit to output a turnoff signal to the second pre-charge switch, and the second pre-charge switch is turned off under the control of the turnoff signal.

12. The display device according to claim 11, wherein the first trigger circuit comprises a first trigger; the first switch circuit comprises a supply voltage, a first resistor, a first switch tube and a second switch tube; the first pre-Charge switch comprises a fifth switch tube;

the control end of the first switch tube is negatively conducted, and the control ends of the second switch tube and the fifth switch tube are positively conducted;

the source of the fifth switch tube is connected to the $N^{th}$ scan line, the drain is connected to the $(N+1)^{th}$ scan line, and the gate is connected to an input pin of the first trigger and is grounded through the first resistor; the source of the first switch tube is connected to the supply voltage, the drain is connected to the gate of the fifth switch tube, and the gate is connected to an output pin of the first trigger; the source of the second switch tribe is connected to the drain of the first switch tube, the drain is grounded, and the gate is connected to the output pin of the first trigger; a control pin of the first trigger is connected to the $N^{th}$ scan line and the $(N+1)^{th}$ scan line separately, and when the control pin of the first trigger receives a rising edge signal, the first trigger assigns the logic level of the input pin to the output pin;

wherein the second trigger circuit comprises a second trigger; the second switch circuit comprises a supply voltage, a second resistor, a third switch tube and a fourth switch tube; the second pre-charge switch comprises a sixth switch tube;

the control end of the third switch tube is negatively conducted, and the control ends of the fourth switch tube and the sixth switch tube are positively conducted;

the source of the sixth switch tube is connected to the $(N+1)^{th}$ scan line, the drain is connected to the $(N+2)^{th}$ scan line, and the gate is connected to an input pin of the second trigger and is grounded through the second resistor; the source of the third switch tube is connected to the supply voltage, the drain is connected to the gate of the sixth switch tube, and the gate is connected to an output pin of the second trigger; the source of the fourth switch tube is connected to the drain of the third switch rube, the drain is grounded, and the gate is connected to the output pin of the second trigger.

13. The display device according to claim 12, wherein the first pre-charge circuit further comprises:

a first diode, having an input end connected to the $N^{th}$ scan line, and an output end connected to the control pin of the first trigger; and a second diode, having an input end connected to the $(N+1)^{th}$ scan line, and an output end connected to the output end of the first diode and the control pin of the first trigger, a fifth diode connected to the output end of the $N^{th}$ scan line and the input end of the scanning line of the $N^{th}$, the fifth diode is to control the output of the gate enabling signal of the scanning line of the $N^{th}$:

wherein the second pre-charge circuit further comprises:

a third diode, having an input end connected to the $(N+1)^{th}$ scan line, and an output end connected to the input end of the second trigger switch circuit; and a fourth diode, having an input end connected to the $(N4-2)^{th}$ scan line, and an output end connected to the output end of the third diode and the input end of the second trigger switch circuit;

the six diode connected to the output end of the $(N+1)^{th}$ scan line and the input end of the scanning line of the $(N\pm1)^{th}$, the six diode is to control the output of the gate enabling signal of the scanning line of the $(N+1)^{th}$.

14. The display device according to claim 11, the display panel comprising multiple pre-charge circuit, the pre-charge circuit comprising a gate enabling signal switch, the gate enabling signal switch connected to the output end of the scan line and the input end of the scanning line, the gate enabling signal switch is to control the output of the gate enabling signal of the scanning line.

15. The display device according to claim 14, wherein the first switch circuit comprises a first reverser and a first resistance, the input of the first reverser connected to the output pin of the first trigger, the output of the first reverser connected to the control ends of the first pre-charge switch, the first resistance grounded at one end, and the other end connected the output of the first reverser and the control ends of the first pre-charge switch the second switch circuit comprises a second reverser and a second resistance, the input of the second reverser connected to the output pin of the second trigger, the output of the second reverser connected to the control ends of the second pre-charge switch, the second resistance grounded at one end, and the other end connected the output of the second reverser and the control ends of the second pre-charge switch.

16. The display device according to claim 14, wherein the control end of the gate enabling signal switch is a negatively conducted.

* * * * *